US006491527B1

(12) United States Patent
Smith

(10) Patent No.: US 6,491,527 B1
(45) Date of Patent: Dec. 10, 2002

(54) DUAL COMPRESSION CONNECTOR

(75) Inventor: Dwight David Smith, Bedford, VA (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/860,056

(22) Filed: May 17, 2001

(51) Int. Cl.[7] ..... H01R 12/00
(52) U.S. Cl. ..... 439/66; 439/70
(58) Field of Search ..... 439/66, 862, 71, 439/908, 525, 68, 69, 70, 72, 91, 263

(56) References Cited

U.S. PATENT DOCUMENTS 4,161,346 A * 7/1979 Cherian et al. ..... 339/17
4,508,405 A * 4/1985 Damon et al. ..... 339/75
5,174,763 A * 12/1992 Wilson ..... 439/66
5,387,134 A 2/1995 Bryce et al.
5,498,166 A * 3/1996 Rothenberger et al. ..... 439/66
5,540,593 A * 7/1996 Takahashi ..... 439/66
5,570,033 A * 10/1996 Staab ..... 324/761
5,727,954 A * 3/1998 Kato et al. ..... 439/66
5,791,914 A * 8/1998 Loranger et al. ..... 439/71
5,902,136 A 5/1999 Lemke et al.
5,993,231 A 11/1999 Hoolhorst
6,083,059 A * 7/2000 Kuan ..... 439/862
6,099,356 A 8/2000 Hwang
6,129,582 A 10/2000 Wilhite et al.
6,135,782 A 10/2000 Cox et al.
6,270,356 B1 * 8/2001 Hoshino et al. ..... 439/70

* cited by examiner

*Primary Examiner*—Tho D. Ta
*Assistant Examiner*—Alexander Gilman
(74) *Attorney, Agent, or Firm*—Coats & Bennett, P.L.L.C.

(57) ABSTRACT

An electrical connector for the connection of electrical devices for data transfer comprises a plurality of conductive elements, each having a central spring area with elongated looped ends as the contact points. The conductive elements are housed in a non-conductive body.

5 Claims, 7 Drawing Sheets

DUAL COMPRESSION CONNECTOR

FIELD OF THE INVENTION

This invention is related to electrical connectors and, in particular, to connectors of the type used to connect mobile devices together for data transfer.

BACKGROUND OF THE INVENTION

This application deals with electrical connectors, the type of which could be used to connect mobile communications or mobile data processing devices together. As an example, the connector could be used to connect various accessories, such as a GPS device, to a cellular telephone. Several difficulties exist with current state of the art connectors and other connectors existing in the prior art.

One problem is that of contact resistance at the point where the leads of the connector contact the contacts on the printed circuit board. Because of asperities existing at a microstructure level on the material of which the leads of the connector and the contact on the circuit board are constructed, the amount of surface area that contacts the connection point for the connector is dependent upon the pressure used to hold the contact against the connection point. The contact resistance is a function of the amount of surface area of the contact which contacts the connection point, and occurs at every contact interface surface. Connectors of the prior art are constructed using two piston like contacts separated by a spring which is compressed and which pushes the piston shaped contacts against their mating contact points. The two interfaces where the spring meets the piston shaped contacts introduces additional contact interface surfaces at which contact resistance exists, thereby limiting the current carrying capacity of the connection. In some cases this may render the connection unusable for the type of accessories that one may wish to connect to the cellular phone. It is therefore desirable to eliminate the contact interfaces between the spring and the piston shaped contact surfaces to lower the contact resistance introduced thereby.

It is possible to eliminate the additional contact interface surfaces with a type of cantilever spring design. In this type of design, each contact contains an "S" or "Z"-shaped bend in the connection between the two contacts at opposite ends of the connector. This cantilever spring type of arrangement will force the contacts outwardly when they are compressed. However, the problem with this type of design is that the size of the hole into which the contact can be housed is limited. It is desirable to have the contacts disposed in holes of very small diameter. Often, the desired diameter holes are so small that the cantilevered type design is untenable. It is therefore necessary and desirable to use the coil type spring, while still eliminating the additional contact interface surfaces between the spring and the contacts.

Another problem with the prior art design is that the geometry of the contacts at the point of contact is not optimal and it is therefore desirable to replace the straight type of contacts with a shape that is better suited for making the contact with the contact point.

SUMMARY OF THE INVENTION

The connector of the current invention utilizes a unique one-piece design for each contact in the connector and consists of a coiled spring having loops at each end which are used as the actual contacts. The one-piece construction eliminates the additional contact interface surfaces between the coiled spring and the contacts and the looped ends provide more stability and a good geometry to connect with the contact point. This type of connector provides the advantage of eliminating the additional contact interface surfaces while at the same time being able to fit into a extremely small diameter hole. Another advantage of this design is the savings involved in the assembly of the connector. Because both contacts and the spring are of unitary construction, it is much less labor intensive to assemble this type of connector then it is to assemble the piston and spring type connector.

DETAILED DESCRIPTION OF THE INVENTION

Figure 1:
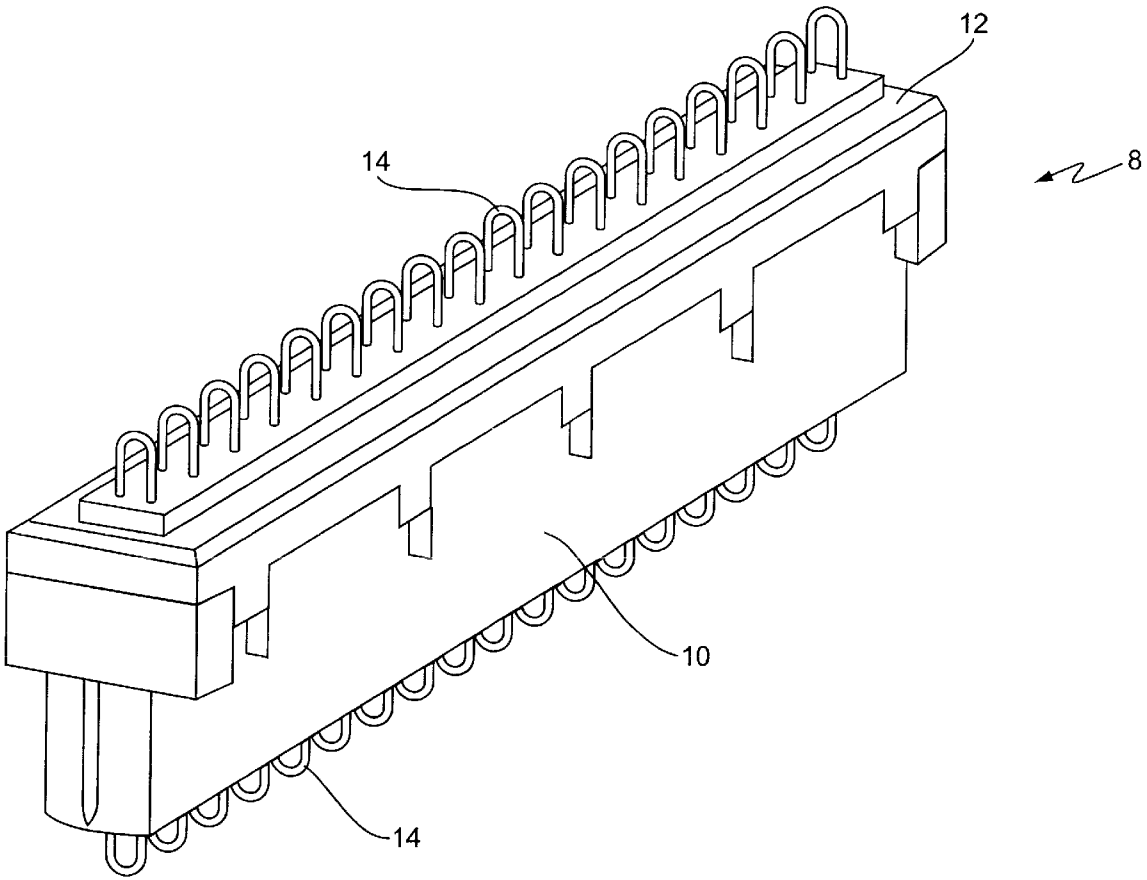
FIG. 1 shows an assembled connector according to this invention.

FIG. 1 shows an assembled connector according to this invention. The connector consists of non-conductive body 10, preferably made of molded plastic, cap 12, also preferably made of molded plastic and a plurality of conductive elements 15 enclosed in body 10 and cap 12. Cap 12 has a plurality of slots through which the looped ends 14 of conductive elements 15 extend. Likewise, body part 10 has, on the underside thereof, a corresponding plurality of slots 12 through which the opposite ends 14 of conductive elements 15 extend. This can be seen in FIG. 3.

Figure 2:
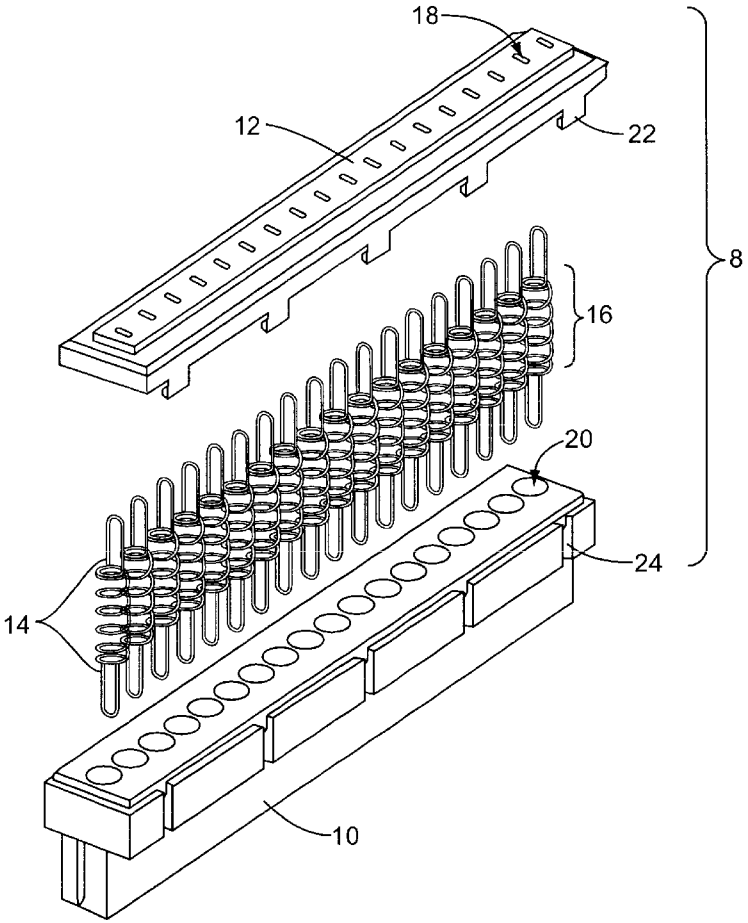
FIG. 2 shows an exploded view of the connector of FIG. 1.
Figure 3:
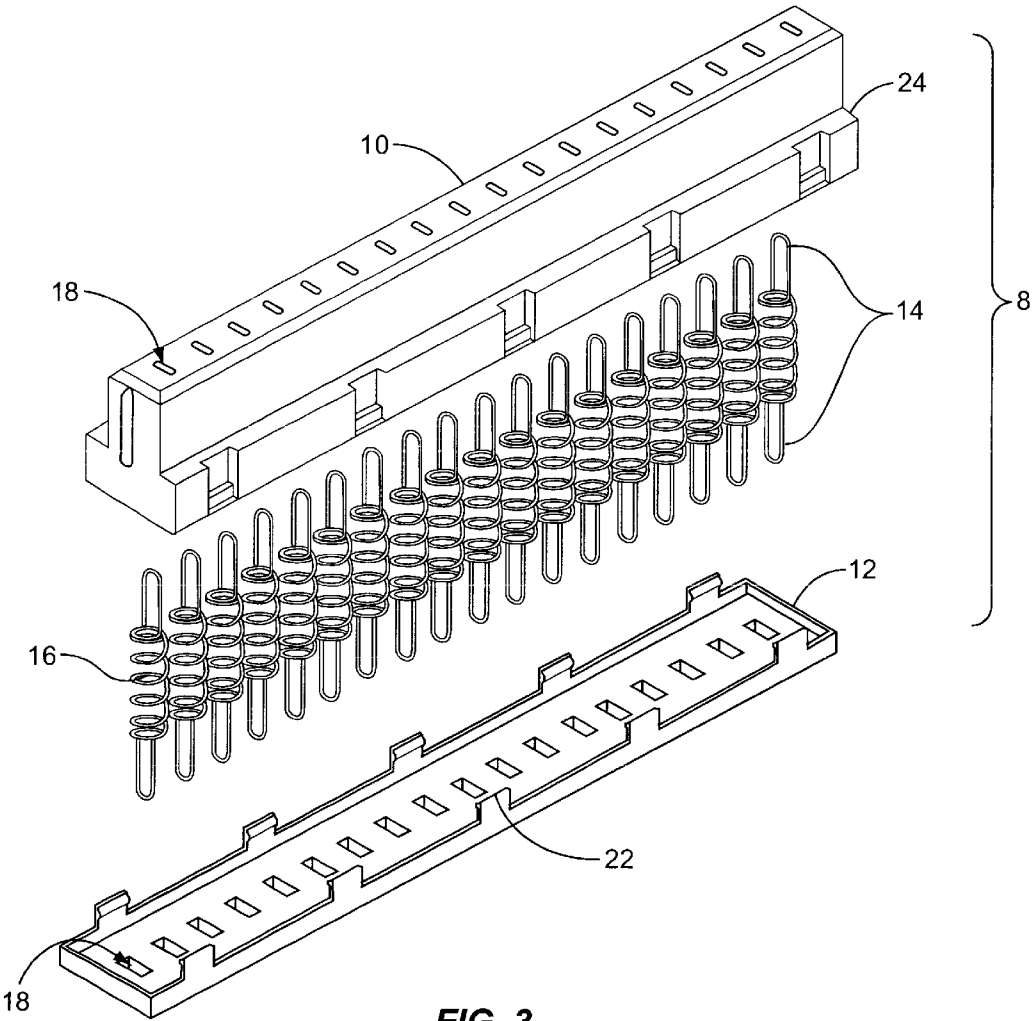
FIG. 3 shows an inverted exploded view of the connector of FIG. 1.

FIG. 2 shows an exploded view of the connector of FIG. 1. The main body part 10 is constructed of molded plastic and contains a plurality of bores 20 defined therein for accepting the plurality of conductive elements 15. Main body 10 also includes a plurality of recesses 24 for accepting clip members 22 defined on cap 12. The plurality of conductive elements 15 are inserted into bores 20 such that the bottom loop 14 extends from slots 18 defined in the bottom of main body 10. Cap 12 is then placed on top of main body 10 such that the upper loops 14 of conductive elements 15 extend through slots 18 defined in cap 12. Note that while the connector of FIGS. 1–3 are shown as having 18 contacts, this invention is not limited thereby but can be used for connectors having any number of contacts. Cap 12 is then compressed onto main body 10 such that clip members 22 engage recesses 24. Clip members 22 may be located either on cap 12 or on main body 10, with the mating recesses being located on the opposite part.

FIG. 3 shows an inverted exploded view of the device of FIG. 1, showing the rectangular slots 18 defined in the bottom of main body part 10.

Figure 6:
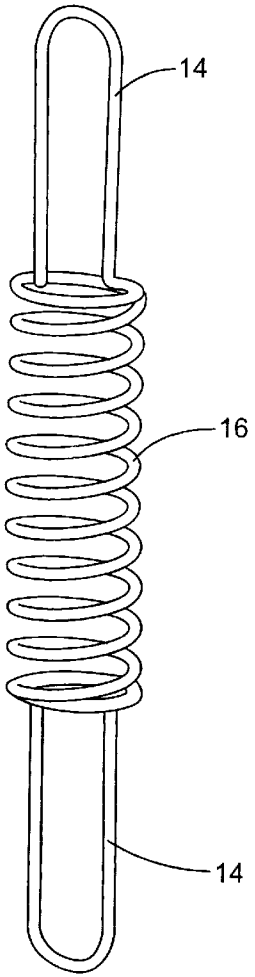
FIG. 6 shows a single spring and the geometry thereof.

One of conductive elements 15 is shown in FIG. 6. Each conductive element 15 essentially consists of a spring portion 16 having defined on each end thereof a loop 14. Although conductive elements 15 may be composed of any conductive material, in the preferred embodiment they are composed of stainless steel plated with nickel and hard gold. As the cap 12 is connected to main body part 10, springs 16 are compressed thereby to provide a preload. Springs 16 are designed and constructed to provide an exact compression force when installed in the intended application. The compression must be sufficient to provide a contact resistance low enough to allow a current sufficient to support the necessary data signals being transmitted by the connector. The design of the springs (i.e., number of turns, material, gauge of wire, etc.) may be varied to provide varying amounts of compression, and therefore varying contact interface resistances when the connector is installed in the intended application.

Figure 7:
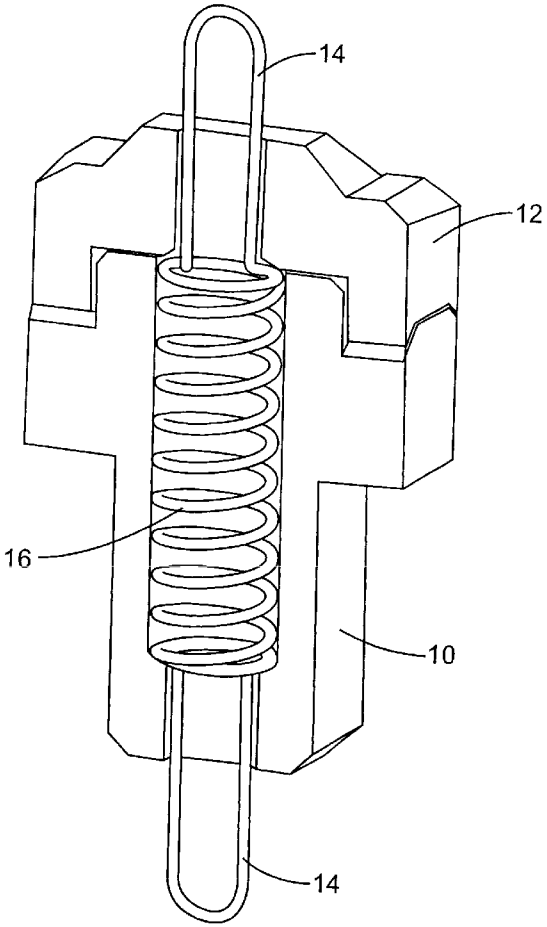
FIG. 7 shows the single spring of FIG. 6 in a cut away of the body of the connector.

FIG. 7 shows spring 15 in place in a cut away section of the molded plastic body of the connector. It can be seen that looped ends 14 extend through openings 18 in cap 12 and main body part 10. The main portion of the cavity in which the spring portion 16 is received is preferably cylindrical in shape. This cylindrical cavity defined in body part 10 and cap 12 can be as small as 1 millimeter or less in diameter. This ability to use a hole of this size is an improvement over the prior art cantilevered design, which limited the size of hole that could be used. This feature of the invention provides a distinct advantage over the prior art, which would require a larger cylindrical cavity in which to receive the spring to provide the same compression as can be achieved in this design.

To assemble the connector, the plurality of springs are inserted in the cavities 20 with bottom loops 14 extending through rectangular slots 18 defined in the main body part 10. Cap 12 is then placed on top of main body 10, allowing upper loops 14 of conductive elements 15 to extend through the rectangular openings 18 and cap 12. Clips 22 in cap 12 are received in recesses 24 defined in main body part 10 and engaged therein, thereby holding cap 12 securely in place and providing a preloaded compression on spring 16.

Figure 4:
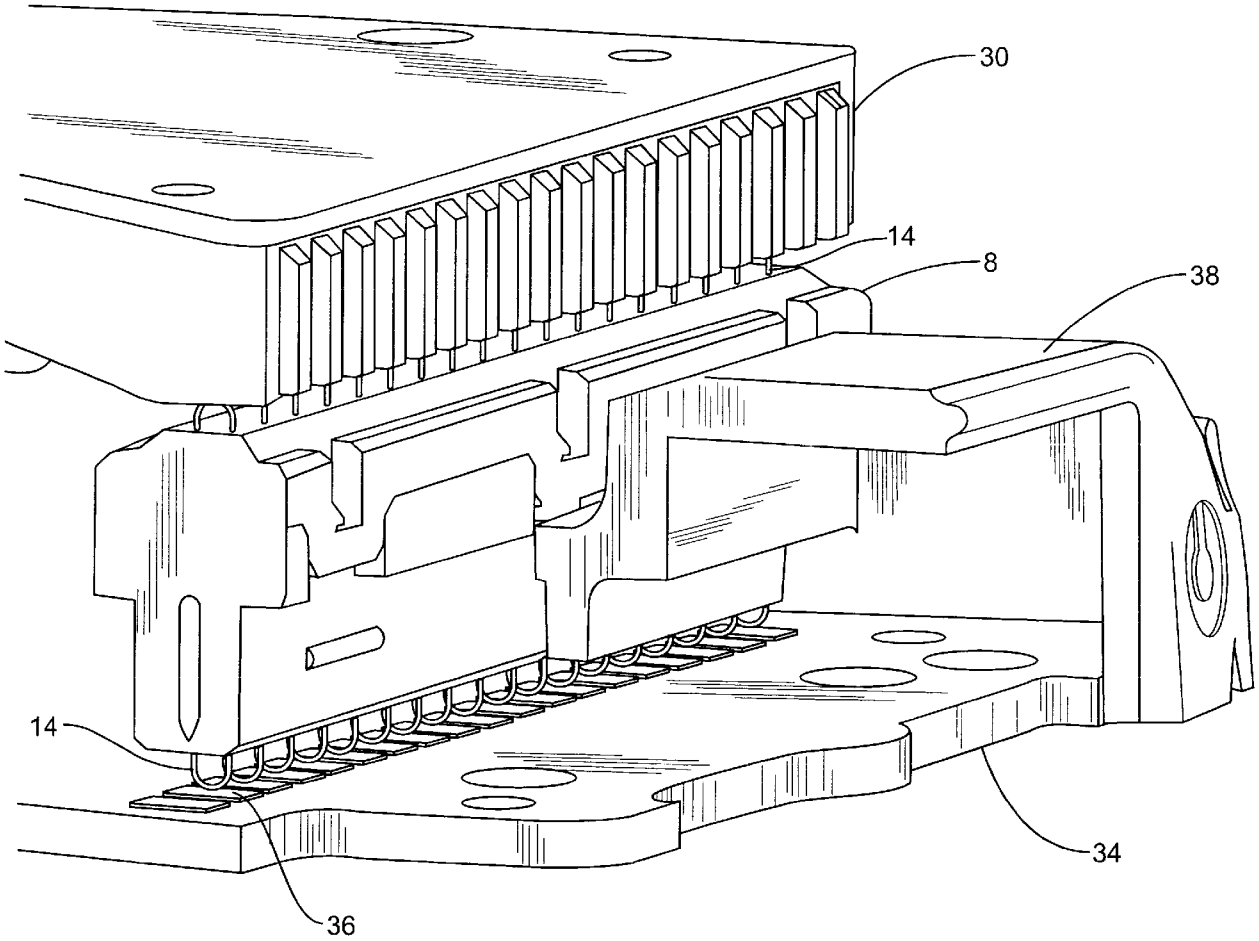
FIG. 4 shows the connector in place in its native environment.
Figure 5:
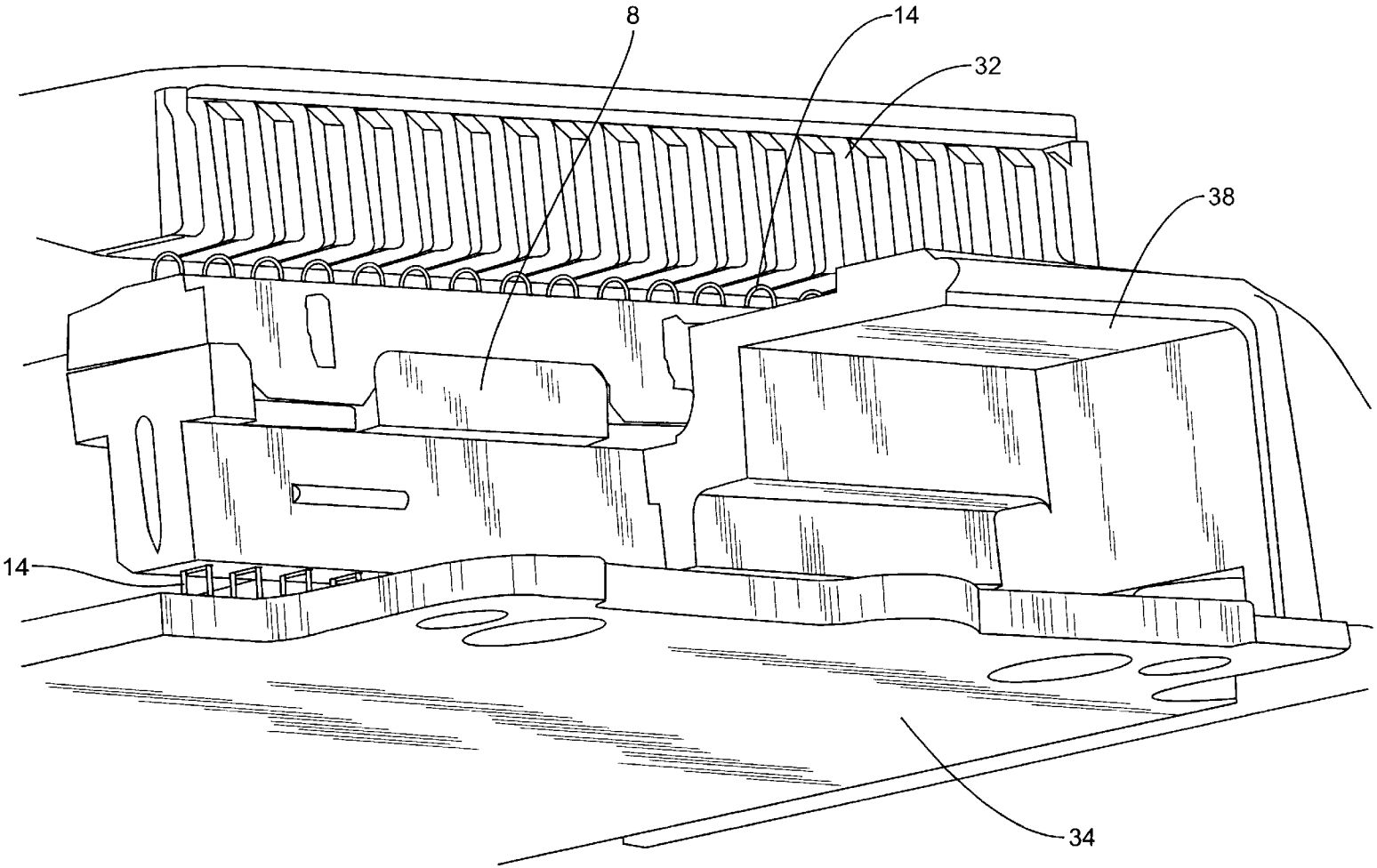
FIG. 5 shows another view of the connector in place in its native environment.

FIGS. 4 and 5 show the connector in place in a typical application, for example, a cellular telephone consisting of frame 38 and main printed circuit board 34 having a plurality of contacts 36 defined thereon. Connector 8 is held in place by frame 38 and the lower looped ends 14 of connector 8 make contact with contacts 36 on printed circuit board 34. FIG. 5 shows another view showing accessory 30 having a plurality of contacts 32 which contact the upper looped ends 14 of connector 8, providing a positive connection between contacts 36 and contacts 32. As springs 16 are compressed by pushing together accessory 30 and main unit 38, the proper amount of electrical conductivity is achieved and contact resistance is minimized.

Although we have shown one embodiment of the connector, it can be seen by one of ordinary skill in the art that the frame consisting of main body part 10 and cap 12 can be made of any non-conductive material and conductors 15 can be comprised of any conductive material capable of providing sufficient construction of spring 16 to provide enough compression force to over come the necessary contact resistance. Additionally, the design parameters of spring 16 may be varied. Further, the connector need not be limited to application in mobile communications or data processing devices, but may be used for any application.

I claim:

1. A connector comprising:

a non-conductive housing having a plurality of spring cavities and openings at opposing ends of the spring cavities, said openings being smaller than the cross-sectional area of the spring cavities;

a plurality of conductive elements, each conductive element comprising:

a helical coil section having first and second ends and disposed within a respective spring cavity; and first and second non-helical contact loops extending from said first and second ends respectively of said helical coil section, and passing through said openings in said spring cavities; and said housing comprising first and second mating parts trapping said helical coil sections of said conductive elements within said spring cavities and applying a compressive preload to the helical coil sections of the conductive elements.

2. The connector of claim 1 wherein said first and second mating parts of said housing are held together by a plurality of clips defined on one of said first and second mating parts, said plurality of clips being engaged by a corresponding plurality of recesses defined in the other of said first and second mating parts.

3. The connector of claim 1 wherein said cavities are cylindrical.

4. The connector of claim 1 wherein said second openings are rectangular slots.

5. The connector of claim 1 wherein said contact loops extend generally parallel to a longitudinal axis of said helical coil section.

* * * * *